US005829683A

United States Patent [19]

Beaudoin et al.

[11] Patent Number: 5,829,683

[45] Date of Patent: Nov. 3, 1998

[54] DEVICE FOR ATOMIZING A LIQUID FUEL USING AN ATOMIZING GAS

[75] Inventors: Philippe Beaudoin, Antony; Stéphane Arnoux, Plaisir, both of France

[73] Assignee: L'Air Liquide, Societe Anonyme pour l'Etude et l'Exploitation des Procedes George Claude, France

[21] Appl. No.: 770,901

[22] Filed: Dec. 20, 1996

[30] Foreign Application Priority Data

Dec. 27, 1995 [FR] France ..... 95 15559

[51] Int. Cl.[6] ..... B05B 7/04

[52] U.S. Cl. ..... 239/429; 239/423; 239/424.5; 239/433

[58] Field of Search ..... 239/398, 418, 239/421, 423, 424, 424.5, 429, 430, 433

[56] References Cited

U.S. PATENT DOCUMENTS

| | | | |
|---|---|---|---|
| 1,647,956 | 11/1927 | Butcher | 239/430 |
| 3,072,344 | 1/1963 | McKenzie | 239/433 |
| 3,446,439 | 5/1969 | Campbell | 239/433 X |
| 3,829,015 | 8/1974 | Monro | 239/430 X |
| 4,989,675 | 2/1991 | Papavergos | 239/433 X |
| 5,368,230 | 11/1994 | Oppenberg | 239/132.5 |
| 5,431,559 | 7/1995 | Taylor | 239/424.5 |

FOREIGN PATENT DOCUMENTS

| | | | |
|---|---|---|---|
| 175658 | 3/1986 | European Pat. Off. . | |
| 388033 | 9/1990 | European Pat. Off. . | |
| 676244 | 10/1995 | European Pat. Off. . | |
| 044697 | 1/1997 | European Pat. Off. . | |
| 2641365 | 7/1990 | France . | |
| 457402 | 3/1928 | Germany | 239/433 |
| 42 38 736 | 5/1994 | Germany . | |

OTHER PUBLICATIONS

Derwent Publications Ltd., Section PQ, Week 8345, Abstract of Swiss Application No. 985 576.

*Primary Examiner*—Andres Kashnikow
*Assistant Examiner*—Robin O. Evans
*Attorney, Agent, or Firm*—Burns, Doane, Swecker & Mathis, L.L.P.

[57] ABSTRACT

A device for atomizing a liquid fuel comprising a central liquid fuel feed passage for feeding with liquid fuel an outer atomizing-gas feed passage for feeding with atomizing gas, these being coaxial overall, an atomizing head extending said passages, the head being equipped for each fluid with one or more ducts which converge into one or more nozzles made in the head and emerging in a combustion region in which the nozzles release a mixture of atomized liquid fuel and of atomizing gas, which head is held at the end of the coaxial passages by a nut screwed onto a wall of the outer passage, wherein the central liquid-fuel feed passage is surrounded by the atomizing-gas feed passage and the atomizing head includes a skirt surrounding inlets to the ducts for the liquid fuel, which skirt is received inside the central passage and the skirt and the said passage respectively have externally and internally complementing cross sections.

20 Claims, 1 Drawing Sheet

DEVICE FOR ATOMIZING A LIQUID FUEL USING AN ATOMIZING GAS

BACKGROUND OF THE INVENTION

1. Field of the Invention

The present invention relates to a device for atomizing a liquid fuel, of the type including two separate passages for feeding with liquid fuel and with atomizing gas, these being coaxial overall, and an atomizing head extending the passages, the head being equipped for each fluid with one or more ducts which converge into one or more nozzles made in the head and emerging in a combustion region in which the nozzles release a mixture of atomized liquid fuel and of atomizing gas, which head is held at the end of the coaxial passages by a nut screwed onto the wall of the outer passage.

2. Description of Related Art

Such devices are already known and are generally known as "Y-atomizers" or "Y-sprays".

They are used, for example, in steam boiler burners in which they are arranged at the center of a stream of air introduced into the boiler directly through a wall.

In the known devices, the liquid fuel, for example fuel oil, is conveyed as far as the atomizing head via the outer feed passage. Thus the atomizing gas, for example steam or air, is brought as far as the head by the central passage arranged at the center of the outer passage.

If the nut which holds the head at the end of the feed passages is not tightened properly then liquid fuel will leak out along the screw thread of the nut. This may occur as a result of the nut being incorrectly fitted, of it having worked loose as a result of the heat, or alternatively of deformation of the bearing faces of the nut which are subjected to high operating temperatures.

In the case of burner employing fuel oil and oxygen, the atomizing device is mounted at the centre of a stream of oxygen. The fuel oil which escapes along the screw thread of the nut catches fire, locally raising the temperature to more than 1000° C., severely damaging the device. This problem has never been identified with air-fuel-oil burners.

SUMMARY AND OBJECTS OF THE INVENTION

The object of the invention is to propose an atomizing device of the aforementioned type which does not have the abovementioned drawbacks, which is more reliable, and which is simple and inexpensive to manufacture.

To this end, the subject of the invention is a device for atomizing a liquid fuel, of the aforementioned type, characterized in that the liquid-fuel feed passage is in a central position and is surrounded by the atomizing-gas feed passage.

According to particular embodiments, the invention may include one or more of the following features:

- the atomizing head includes a skirt surrounding the inlets to the ducts for the liquid fuel, which skirt is received inside the central passage and the said skirt and the said passage respectively have externally and internally complementing cross sections;
- the said skirt has a length which is more than twice its outside diameter, especially a length equal to four times its outside diameter;
- the said skirt at its distal end has a seal providing sealing between the said skirt and the interior wall of the central passage;

- successive annular grooves are made along the length of the exterior wall of the skirt;
- the said skirt in its proximal part has an external screw thread and the front end of the central passage has a complementary tapping;
- the nut is provided with substantially longitudinal drillings emerging on the one side at the interface between the atomizing head and the exterior wall of the outer passage and on the other side in the combustion region;
- the nut has a re-entrant rim interacting with a shoulder of the atomizing head so as to keep the latter at the end of the passages which are coaxial overall, and the said re-entrant rim completely covers the exposed lateral wall of the said head;
- upstream of the said atomizing head it has a sleeve tube, the axial opening of which forms the said central liquid-fuel feed passage, which sleeve tube is provided with a ring of longitudinal drillings surrounding the said central passage and forming the said atomizing-gas feed passage; and
- there is a seal at the interface between the atomizing head and the wall of the outer atomizing-gas feed passage.

More particularly, the solution to the leak problem identified with pure or substantially pure oxygen (more than 85% of O2) and fuel oil is solved by the use of a seal with the arrangement of means described hereabove.

The invention will be better understood from reading the description which will follow, given merely by way of example and made with reference to the drawings.

DETAILED DESCRIPTION OF PREFERRED EMBODIMENT

Figure 1:
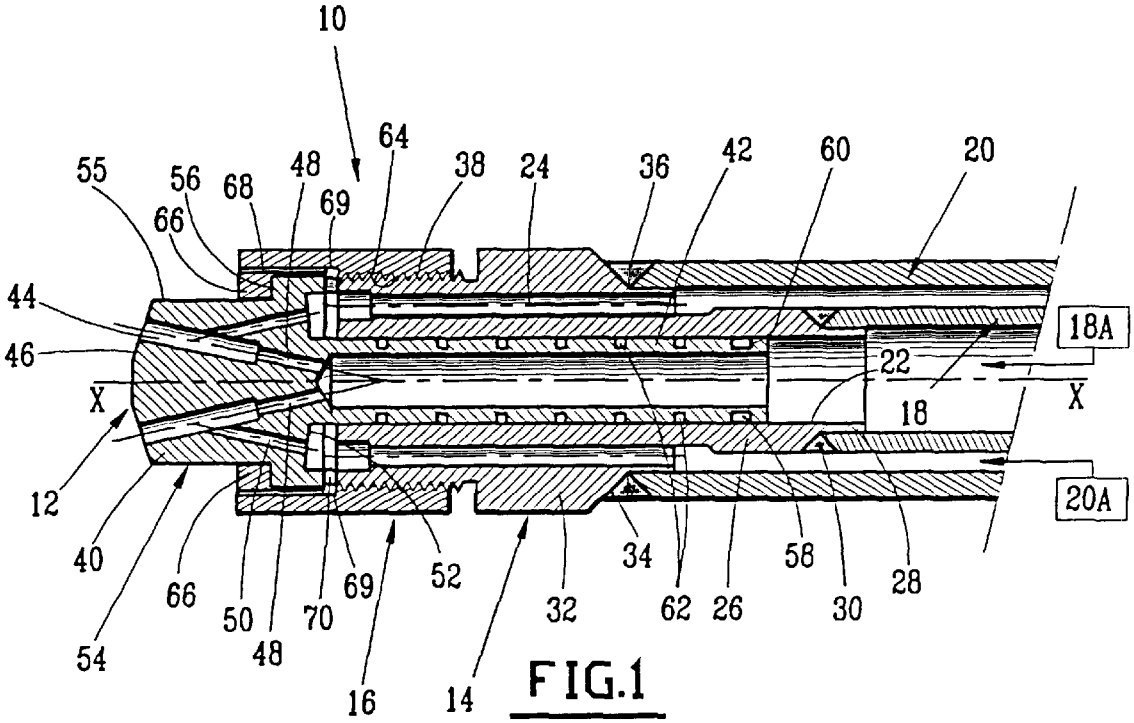
FIG. 1 is a view in longitudinal section of a first embodiment of an atomizing device according to the invention.

The atomizing device 10 represented in FIG. 1 includes an atomizing head 12 mounted at the end of a connector 14 by means of a nut 16. It generally has symmetry of revolution of axis X—X, the atomizing head being assumed to be at the front.

The connector 14 is welded to the ends of two coaxial pipes 18, 20. The inner pipe 18 feeds the atomizing device with the liquid fuel, fuel oil for example, from a pressurized source 18A. The outer pipe 20 feeds the device with atomizing gas, steam for example, from a pressurized source 20A.

The connector 14 is formed by a sleeve tube of axis X—X including an axial cylindrical passage 22. This passage is intended to feed the head 12 with liquid fuel. Furthermore, passing right through the sleeve tube is a ring of twelve longitudinal drillings 24 arranged at the periphery of the passage 22. These drillings 24 are intended to feed the head 12 with atomizing gas.

The thickness of the sleeve tube is reduced on the outside in its rear part so that the passage 22 is extended beyond the drillings 24. The rear part of the passage 22 is delimited by a joining piece 26 including an end skirt 28 intended to be engaged in the pipe 18. The latter is welded by an annular bead of welding 30 to the joining piece 26.

At the drillings 24 the sleeve tube has increased thickness 32 on the outside, with a rear chamber 34 to which the pipe 20 is welded by an annular bead of welding 36.

A screw thread 38 is formed at the front on the exterior wall of the sleeve tube for screwing on the nut 16.

The atomizing head 12 generally has symmetry of revolution of axis X—X. At the front it has an atomizing unit 40 extended at the rear by a skirt 42 received in the passage 22.

The atomizing unit 40 is formed of a solid metallic cylinder in which six cylindrical atomizing nozzles 44 having a diameter of 2.4 mm are formed. These nozzles emerge on the front surface 46 of the atomizing unit in the combustion region. They form an angle of approximately 15° with the axis X—X. The periphery of the front surface 46 on which the nozzles 44 emerge is frustoconical so that the nozzles emerge at right angles to this surface.

The nozzles 44 are extended backwards by ducts 48 of small diameter, for example 1.6 mm. These ducts 48 emerge close to the axis X—X inside the space delimited by the skirt 42. They are intended to convey fluid fuel as far as the nozzles 44.

Ducts 50 for conveying the atomizing gas emerge at their front end laterally inside the nozzles 44 and at their rear end in an annular groove 52 surrounding the skirt 42. The diameter of this groove corresponds substantially to the diameter of the ring of drillings 24. The ducts 50 have a diameter identical to that of the ducts 48.

From its front end, the atomizing unit 40 has, on the outside, a reduced-diameter portion 54 which thus delimits a cylindrical lateral wall 55 of circular cross section extended by a shoulder 56.

The skirt 42 has an outside diameter substantially equal to the inside diameter of the passage 22. An O-ring 58 is arranged in a groove 60 formed on the outside at the distal end of the skirt 42. Successive complementary grooves 62 are formed on the exterior wall of the skirt 42 along its entire length between its distal end and its proximal end where it is connected to the atomizing unit 40.

The length of the skirt 42 is more than twice its outside diameter and is, for example, as represented in the figures, equal to four times its diameter.

The nut 16 at the rear has an internal screw thread 64 intended to interact with the screw thread 38. AL the front it has a peripheral re-entrant rim 66 intended to interact with the shoulder 56 in order to keep the head 12 at the end of the connector 14. Two flats 67 (not represented in FIG. 1) are provided on the exterior wall of the nut to allow it to be turned with an open-ended spanner.

Moreover, longitudinal drillings 68, for example six of these, are made in the nut 16. They emerge on the one hand on the front face of the nut and on the other hand in an interior groove 69 provided immediately in front of the screw thread 64 at the interface between the atomizing head 12 and the exterior wall of the longitudinal drillings 24.

To assemble the atomizing device, the connector 14 is welded axially to the end of the inner pipe 18 then to the end of the outer pipe 20. Next, the skirt 42 fitted with the seal 58 is inserted inside the passage 22. A flat gasket 70, for example one made of cooper, is interposed at the interface between the rear of the atomizing unit 40 and the front of the connector 14 on the outside of the annular groove 52. This gasket has a diameter larger than the ring of drillings 24 and a thickness substantially equal to the width of the groove 69.

The nut 16 is then fitted on the atomizing unit 40 and is screwed onto the screw thread 38. It keeps the head 12 at the end of the connector 14 in such a way that on the one hand, the ducts 48 communicate with the central fluid-fuel feed passage 22 and, on the other hand, the ducts 50 communicate via the groove 52 with the peripheral atomizing-gas feed drillings 24.

It will be understood that with such a device, the liquid fuel and the atomizing gas are conveyed separately as far as the nozzles 44 where the liquid fuel is atomized under the effect of the pressure of the atomizing gas. To achieve this, the liquid fuel may be fed with a flow rate of 360 kg/h under a pressure of 3 to 4 bar gauge, while the atomizing gas is supplied at a pressure of 5 bar gauge.

As the atomizing gas surrounds the liquid fuel, any leaks which may occur at the nut 16 can only be leaks of atomizing gas, which present no significant danger to the nut, as the gas is non-inflammable. Furthermore, to protect the nut 16 against corrosion if the atomizing gas is steam, the drillings 68 allow any atomizing gas which may have escaped beyond the gasket 70 to be discharged. The screw threads 38 and 64 are thus protected.

Moreover, the length of the skirt 42 inserted into the fluid-fuel feed passage 22 limits the risk of fuel leaking into the annular stream of atomizing gas. This sealing is moreover provided by the seal 58 and the grooves 62 which create successive pressure drops along the skirt 42.

Figure 2:
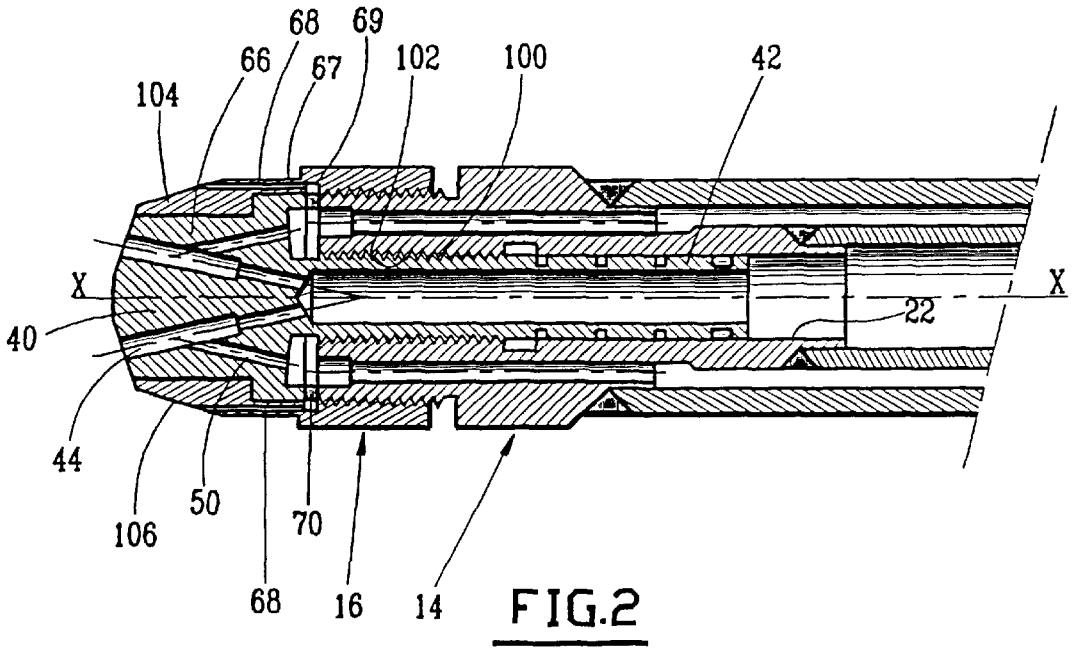
FIG. 2 is a similar view of an alternative form of the atomizing device according to the invention.

FIG. 2 represents an alternative form of the atomizing device of FIG. 1.

In this figure, the references which are identical to those of FIG. 1 denote components or parts of components which are similar. Only the differences between the devices of FIGS. 1 and 2 will be described in the remainder of the description.

In this alternative form, the skirt 42 is equipped on the outside at its proximal end with an external screw thread 100 intended to interact with a complementary tapping 102 formed at the front end of the passage 22. The screw thread 100 extends over approximately one third of the length of the skirt 42. This particular arrangement allows the atomizing head 12 to be screwed onto the connector 14, further improving the seal between the passage 22 and the skirt 42. It also makes it possible to hold the head on should the nut 16 be lost.

What is more, the rim 66 of the nut 16 is extended forwards by a skirt 104 which covers the entire lateral wall 55 of the atomizing unit 40. This skirt has an external chamfer 106 on which the end of the drillings 68 emerges. This particular arrangement gives increased protection of the atomizing unit 40 against thermal or chemical aggression due to the atmosphere prevailing in the combustion region.

The atomizing heads described here include several atomizing nozzles. However, it is possible to provide a single axial nozzle towards which several outer atomizing-gas feed ducts converge. This nozzle is fed with liquid fuel by a single axial duct.

We claim:

1. A device for atomizing a liquid fuel comprising a central liquid fuel feed passage for feeding with liquid fuel an outer atomizing-gas feed passage for feeding with atomizing gas, these being coaxial overall, an atomizing head extending said passages, said head being equipped for each fluid with one or more ducts which converge into one or more nozzles made in the head and emerging in a combustion region in which the nozzles release a mixture of atomized liquid fuel and of atomizing gas, which head is held at the end of the coaxial passages by a nut screwed onto a wall of the outer passage, wherein the central liquid-fuel feed passage is surrounded by the atomizing-gas feed passage and the atomizing head includes a skirt surrounding inlets to the ducts for the liquid fuel, which skirt is received inside the central passage and said skirt and the said passage respectively have externally and internally complementing cross sections, wherein said skirt has an exterior wall comprising successive annular grooves along its length.

2. The atomizing device according to claim 1, wherein said skirt has a length which is more than twice its outside diameter.

3. The atomizing device according to claim 1 wherein said skirt at its distal end comprises a seal providing sealing between said skirt and an interior wall of the central passage.

4. The atomizing device according to claim 2 wherein said skirt has a length which is equal to four times its outside diameter.

5. The atomizing device according to claim 1, wherein said skirt has a proximal part comprising an external screw thread and said central passage has a front end comprising a complementary tapping.

6. The atomizing device according to claim 1 wherein said nut comprises substantially longitudinal drillings emerging on one side at an interface between the atomizing head and an exterior wall of the outer passage and on another other side in the combustion region.

7. The atomizing device according to claim 1 wherein the nut further comprises a reentrant rim interacting with a shoulder of the atomizing head so as to keep the atomizing head at the end of the passages which are coaxial overall, and wherein said re-entrant rim completely covers an exposed lateral wall of said head.

8. The atomizing device according to claim 1, further comprising, upstream of said atomizing heads, a sleeve tube having an axial opening which forms said central liquid-fuel feed passage, which sleeve tube is provided with a ring of longitudinal drillings surrounding said central passage and forming said atomizing-gas feed passage.

9. The atomizing device according to claim 1, further comprising a seal at an interface between the atomizing head and at a wall of the outer atomizing-gas feed passage.

10. A device for atomizing a liquid fuel comprising a central liquid fuel feed passage for feeding with liquid fuel an outer atomizing-gas feed passage for feeding with atomizing gas, these being coaxial overall, an atomizing head extending said passages, said head being equipped for each fluid with one or more ducts which converge into one or more nozzles made in the head and emerging in a combustion region in which the nozzles release a mixture of atomized liquid fuel and of atomizing gas, which head is held at the end of the coaxial passages by a nut screwed onto a wall of the outer passage, wherein the central liquid-fuel feed passage is surrounded by the atomizing-gas feed passage and the atomizing head includes a skirt surrounding inlets to the ducts for the liquid fuel, which skirt is received inside the central passage and said skirt and the said passage respectively have externally and internally complementing cross sections, wherein said nut comprises substantially longitudinal drillings emerging on one side at an interface between the atomizing head and an exterior wall of the outer passage and on another other side in the combustion region.

11. The atomizing device according to claim 10, wherein said skirt has a length which is more than twice its outside diameter.

12. The atomizing device according to claim 10, wherein said skirt at its distal end comprises a seal providing sealing between said skirt and an interior wall of the central passage.

13. The atomizing device according to claim 10, wherein said skirt has a proximal part comprising an external screw thread and said central passage has a front end comprising a complementary tapping.

14. The atomizing device according to claim 10, wherein the nut further comprises a re-entrant rim interacting with a shoulder of the atomizing head so as to keep the atomizing head at the end of the passages which are coaxial overall, and wherein said re-entrant rim completely covers an exposed lateral wall of said head.

15. The atomizing device according to claim 10, further comprising, upstream of said atomizing head, a sleeve tube having an axial opening which forms said central liquid-fuel feed passage, which sleeve tube is provided with a ring of longitudinal drillings surrounding said central passage and forming said atomizing-gas feed passage.

16. A device for atomizing a liquid fuel comprising a central liquid fuel feed passage for feeding with liquid fuel an outer atomizing-gas feed passage for feeding with atomizing gas, these being coaxial overall, an atomizing head extending said passages, said head being equipped for each fluid with one or more ducts which converge into one or more nozzles made in the head and emerging in a combustion region in which the nozzles release a mixture of atomized liquid fuel and of atomizing gas, which head is held at the end of the coaxial passages by a nut screwed onto a wall of the outer passage, wherein the central liquid-fuel feed passage is surrounded by the atomizing-gas feed passage and the atomizing head includes a skirt surrounding inlets to the ducts for the liquid fuel, which skirt is received inside the central passage and said skirt and the said passage respectively have externally and internally complementing cross sections, and upstream of said atomizing head, a sleeve tube having an axial opening which forms said central liquid-fuel feed passage, which sleeve tube is provided with a ring of longitudinal drillings surrounding said central passage and forming said atomizing-gas feed passage.

17. The atomizing device according to claim 16, wherein said skirt has a length which is more than twice its outside diameter.

18. The atomizing device according to claim 16, wherein said skirt at its distal end comprises a seal providing sealing between said skirt and an interior wall of the central passage.

19. The atomizing device according to claim 16, wherein said skirt has a proximal part comprising an external screw thread and said central passage has a front end comprising a complementary tapping.

20. The atomizing device according to claim 16, wherein the nut further comprises a re-entrant rim interacting with a shoulder of the atomizing head so as to keep the atomizing head at the end of the passages which are coaxial overall, and wherein said re-entrant rim completely covers an exposed lateral wall of said head.

* * * * *